United States Patent [19]

Nozawa et al.

[11] 4,452,885

[45] Jun. 5, 1984

[54] HEAT-DEVELOPABLE PHOTOGRAPHIC MATERIAL

[75] Inventors: Yasushi Nozawa; Tadayoshi Kokubo; Isamu Itoh; Hiroshi Kitaguchi, all of Kanagawa, Japan

[73] Assignee: Fuji Photo Film Co., Ltd., Kanagawa, Japan

[21] Appl. No.: 428,519

[22] Filed: Sep. 29, 1982

[30] Foreign Application Priority Data

Oct. 6, 1981 [JP] Japan ..... 56-159265

[51] Int. Cl.[3] ..... G03C 1/34; G03C 1/02

[52] U.S. Cl. ..... 430/614; 430/618; 430/619; 430/620; 430/495; 430/178

[58] Field of Search ..... 430/618, 619, 620, 614, 430/617, 178, 495

[56] References Cited

U.S. PATENT DOCUMENTS

| | | | |
|---|---|---|---|
| 3,707,377 | 12/1972 | Tiers et al. | 430/619 |
| 3,874,946 | 1/1975 | Costa et al. | 430/617 |
| 3,955,982 | 5/1976 | Van Allan et al. | 430/619 |
| 4,359,524 | 11/1982 | Masuda et al. | 430/620 |

*Primary Examiner*—Won H. Louie, Jr.

*Attorney, Agent, or Firm*—Sughrue, Mion, Zinn, Macpeak, and Seas

[57] ABSTRACT

A heat-developable photographic material is disclosed. The material is comprised of (a) an organic silver salt, (b) a photocatalyst, (c) a reducing agent, (d) a binder, and (e) at least one compound selected from the group consisting of 2-trihalogenomethyl-3,4-oxadiazoles and the derivatives thereof as an antifogging agent. The use of component (e) does not present environmental pollution problems and successfully reduces fog density.

18 Claims, No Drawings

HEAT-DEVELOPABLE PHOTOGRAPHIC MATERIAL

FIELD OF THE INVENTION

This invention relates to a heat-developable photographic material and, more particularly, to a heat-developable photographic material which prevents the occurrence of fog.

BACKGROUND OF THE INVENTION

Silver halide materials have photographic properties, such as sensitivity, gradation, resolution and so on which are superior to other means of photographic reproduction such as electrophotography, diazo photography and so on. Because of these superior properties, it has been the most prevailing type of photographic material. Recently, various techniques for simply and rapidly producing an image have been developed. These techniques involve changing the method for processing latent images formed in photographic materials of silver halide-using type from the conventional wet developing method using a developing solution or the like to the dry developing method using a heating means or the like.

The most successful examples in the art of photographic materials of the kind which can produce photographic images using such a dry processing method as described above are at present heat-developable photographic materials such as those described in U.S. Pat. Nos. 3,152,904 and 3.457,075. These patents disclose utilizing compositions which contain, as essential components, an organic silver salt, a catalytically small amount of photocatalyst (e.g., silver halide) and a reducing agent, respectively. These photographic materials are stable at an ordinary temperatures. However, when heated to a temperature of about 80° C. or higher, and preferably 100° C. or higher, after imagewise exposure, the photographic material produces silver through a redox reaction of the organic silver salt, which can act as an oxidizing agent, with the reducing agent which takes place in its light-sensitive layer by the catalytic action of the optically exposed photocatalyst present in the neighhborhood of the above-described agents. The silver which is produced in the exposed area of the light-sensitive layer is rapidly blackened to produce a contrast with respect to the unexposed area (background), i.e., to result in the formation of an image.

However, conventional heat-developable photographic materials are not particularly desirable due to the generation of silver which can be seen in areas which should be image-free and, consequently, white, that is, fog is generated.

The most effective means for reducing the fog, though it is almost impossible to completely prevent the occurrence of fog, is at present, to use the mercury compounds described in Japanese Patent Publication No. 11113/72 (corresponding to U.S. Pat. No. 3,589,903).

However, mercury compounds are virulently poisonous, and cannot be employed due to the environmental pollution which is created because, for example, mercury is transpired when the photographic material is submitted to heat-development and, further, the mercury is liable to effuse from the photographic material if it is scrapped after use.

U.S. Pat. Nos. 3,955,982 and 3,874,946, Japanese Patent Application (OPI) Nos. 70543/76 and 99335/76 (the term "OPI" as used herein refers to a "published unexamined Japanese patent application"), and so on describe that certain organic polyhalogheno compounds are useful as antifoggants for heat-developable photographic materials. However, the antifogging effect obtained with these compounds is much lower than that which is obtained using mercury compounds.

SUMMARY OF THE INVENTION

Therefore, an object of this invention is to provide a heat-developable photographic material in which fog is prevented from occurring by using a compound having reduced toxicity.

Another object of this invention is to provide a heat-developable photographic material in which the fog density of the white background after development is reduced.

The above-described objects are attained with a heat-developable photographic material, which comprises at least (a) an organic silver salt, (b) a photocatalyst, (c) a reducing agent and (d) a binder, into which (e) at least one compound selected from the group consisting of 2-trihalogenomethyl-3,4-oxadiazoles and derivatives thereof is further incorporated.

DETAILED DESCRIPTION OF THE INVENTION

2-Trihalogenomethyl-3,4-oxadiazoles and their derivatives of this invention are much lower in toxicity than the mercury compounds described in Japanese Patent Publication No. 11113/72. Furthermore, they have remarkable antifogging effects, compared with conventional organic polyhalogeno compounds known as stabilizers. 2-Trihalogenomethyl-3,4-oxadiazoles and their derivatives of this invention are represented by the following general formula:

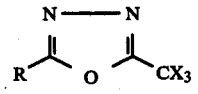

wherein X represents a halogen atom, and R represents hydrogen, or an alkyl group, an aryl group, an aralkyl group, an alkenyl group or a heterocyclic residue, each of which may be substituted.

X may be any of the halogens, F, Cl, Br or I. However, the antifogging effect is especially large when X is Br.

Preferable alkyl groups represented by R are those having 1 to 18 carbon atoms, with specific examples including a methyl group, an ethyl group, a propyl group, an i-propyl group, an octyl group, a palmityl group and the like.

Preferable aryl groups represented by R are a phenyl group and a naphthyl group, and a phenyl group is especially preferred.

Preferable aralkyl groups represented by R are those having 7 to 30 carbon atoms, with specific examples including a phenylmethyl group, a phenylethyl group and the like.

Preferable alkenyl groups represented by R are those having 2 to 30 carbon atoms, with specific examples including a vinyl group, a styryl group, a propenyl group, a butenyl group and the like.

Preferable heterocyclic residues are 5- or 6-membered heterocyclic residues which each contains at least one hetero atom selected from O, N and S, and residues of the condensed rings thereof, with specific examples including residues of pyridine, pyrimidine, triazine, tetrazine, pyrrole, imidazole, pyrazole, triazole, oxazole, thiazole, benzimidazole, indole, purine, benzoxazole, benzothiazole, furan, thiophene and like rings.

The alkyl group, the aryl group, the aralkyl group, the alkenyl group and the heterocyclic residue represented by R in the above-described general formula may have substituent groups. Preferable examples of such substituent groups include halogen atoms, a hydroxyl gropu, alkoxyl groups, an oxycarbonyl group, an oxysulfonyl group, an acyl group, a carboxy group, an acyloxy group, a carbamoyl group, amino groups, amido groups, alkylsulfonyl groups, arylsulfonyl groups, a mercapto group, alkylthio groups, a sulfo group, a sulfamoyl group, a nitro group, a cyano group and so on.

Of the groups represented by R, alkyl, aryl, aralkyl and alkenyl groups are preferred and particularly preferred groups include lower alkyl groups, aryl groups and a styryl group.

Preferable examples of 2-trihalogenomethyl-3,4-oxadiazoles or derivatives thereof employed in this invention are enumerated below.

(1) 2-Tribromomethyl-3,4-oxadiazole
(2) 2-Tribromomethyl-5-methyl-3,4-oxadiazole
(3) 2-Tribromomethyl-5-n-butyl-3,4-oxadiazole
(4) 2-Tribromomethyl-5-t-butyl-3,4-oxadiazole
(5) 2-Tribromomethyl-5-octyl-3,4-oxadiazole
(6) 2-Tribromomethyl-5-palmityl-3,4-oxadiazole
(7) 2-Tribromomethyl-5-chloromethyl-3,4-oxadiazole
(8) 2-Tribromomethyl-5-bromomethyl-3,4-oxadiazole
(9) 2-Tribromomethyl-5-cyanomethyl-3,4-oxadiazole
(10) 2-Tribromomethyl-5-phenylsulfonylmethyl-3,4-oxadiazole
(11) 2-Tribromomethyl-5-phenoxymethyl-3,4-oxadiazole
(12) 2-Tribromomethyl-5-methylthiomethyl-3,4-oxadiazole
(13) 2-Tribromomethyl-5-acetylmethyl-3,4-oxadiazole
(14) 2-Tribromomethyl-5-(2-ethoxycarbonylethyl)-3,4-oxadiazole
(15) 2-Tribromomethyl-5-(2-methoxyethyl)-3,4-oxadiazole
(16) 2-Tribromomethyl-5-(1-bromoethyl)-3,4-oxadiazole
(17) 2-Tribromomethyl-5-(2-bromoethyl)-3,4-oxadiazole
(18) 2-Tribromomethyl-5-(8-methoxycarbonylbutyl)-3,4-oxadiazole
(19) 2-Tribromomethyl-5-(2-carboxyethyl)-3,4-oxadiazole
(20) 2-Tribromomethyl-5-(6-aminohexyl)-3,4-oxadiazole
(21) 2-Tribromomethyl-5-phenyl-3,4-oxadiazole
(22) 2-Tribromomethyl-5-(p-tolyl)-3,4-oxadiazole
(23) 2-Tribromomethyl-5-(p-anisyl)-3,4-oxadiazole
(24) 2-Tribromomethyl-5-(o-anisyl)-3,4-oxadiazole
(25) 2-Tribromomethyl-5-(m-chlorophenyl)-3,4-oxadiazole
(26) 2-Tribromomethyl-5-(p-chlorophenyl)-3,4-oxadiazole
(27) 2-Tribromomethyl-5-(m-cyanophenyl)-3,4-oxadiazole
(28) 2-Tribromomethyl-5-(p-cyanophenyl)-3,4-oxadiazole
(29) 2-Tribromomethyl-5-(p-dodecyloxyphenyl)-3,4-oxadiazole
(30) 2-Tribromomethyl-5-(p-hydroxyphenyl)-3,4-oxadiazole
(31) 2-Tribromomethyl-5-(o-hydroxyphenyl)-3,4-oxadiazole
(32) 2-Tribromomethyl-5-(p-nitrophenyl)-3,4-oxadiazole
(33) 2-Tribromomethyl-5-(p-aminophenyl)-3,4-oxadiazole
(34) 2-Tribromomethyl-5-(p-dimethylaminophenyl)-3,4-oxadiazole
(35) 2-Tribromomethyl-5-(p-methylsulfonylmethyl)-3,4-oxadiazole
(36) 2-Tribromomethyl-5-(o-methylthiophenyl)-3,4-oxadiazole
(37) 2-Tribromomehthyl-5-(p-methylthiophenyl)-3,4-oxadiazole
(38) 2-Tribromomethyl-5-vinyl-3,4-oxadiazole
(39) 2-Tribromomethyl-5-propenyl-3,4-oxadiazole
(40) 2-Tribromomethyl-5-styryl-3,4-oxadiazole
(41) 2-Tribromomethyl-5-(p-methylstyryl)-3,4-oxadiazole
(42) 2-Tribromomethyl-5-(p-methoxystyryl)-3,4-oxadiazole
(43) 2-Tribromomethyl-5-phenylmethyl-3,4-oxadiazole
(44) 2-Tribromomethyl-5-(p-methylphenylmethyl)-3,4-oxadiazole
(45) 2-Tribromomethyl-5-(3-pyridyl)-3,4-oxadiazole
(46) 2-Tribromomethyl-5-(4-pyridyl)-3,4-oxadiazole
(47) 2-Tribromomethyl-5-(6-pyrimidyl)-3,4-oxadiazole
(48) 2-Tribromomethyl-5-(2-oxazyl)-3,4-oxadiazole
(49) 2-Tribromomethyl-5-(2-furyl)-3,4-oxadiazole
(50) 2-Tribromomethyl-5-(2-thienyl)-3,4-oxadiazole
(51) 2-(Chlorodibromomethyl)-5-phenyl-3,4-oxadiazole
(52) 2-(Dichlorobromomethyl)-5-phenyl-3,4-oxadiazole More preferable examples of 2-trihalogenomethyl-3,4-oxadiazoles or derivatives thereof include the above-described compounds represented by (2) to (6), (16), (21), (26) and (45).

The 2-trihalogenomethyl-3,4-oxadiazole compounds of this invention can be easily synthesized according to, for example, the process illustrated hereinafter.

The amount of above-described compound (component (e)) of this invention which is used depends upon the particular compound used. However, it is preferably used in an amount of from $10^{-5}$ to 1 mol, and more preferably from $10^{-3}$ to $5\times10^{-1}$ mol, per mol of silver. The amount used should not be construed as being limited to this range.

The above-described compounds are synthesized by treating a diacylhydrazine with phosphorus oxychloride, as described in M. P. Hutt, E. F. Elslager and L. M. Weber, *J. Heterocyclic Chem.*, Vol. 7, Number (3), page 511 (1970). That is, a hydrizide (2) reacts with tribromoacetic acid chloride to produce a diacylhydrazine (3) and, further, treated with phosphorus oxychloride to give an intended compound (1), as illustrated by the following reaction scheme:

$$\underset{(2)}{RC(=O)NHNH_2} \xrightarrow{CBr_3COCl} \underset{(3)}{RC(=O)NHNHC(=O)CBr_3} \xrightarrow{POCl_3}$$

-continued

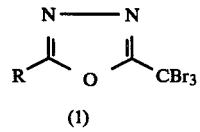

(1)

SYNTHESIS EXAMPLE 1

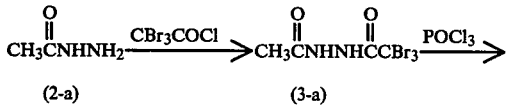

(2-a) (3-a)

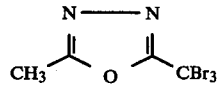

(1-a)

4.68 g (0.063 mol) of acetohydrazide (2-a) and 5 g (0.063 mol) of pyridine were dissolved in 50 ml of acetonitrile, and stirred with cooling in an ice-bath. Thereto, a solution of 20 g (0.064 mol) of tribromoacetic acid chloride (which was prepared from tribromoacetic acid and thionyl chloride, and had b.p. of 800°-81° C./17 mm Hg) dissolved in 20 ml of acetonitrile was added dropwise. After the conclusion of the dropwise addition, the stirring ring was further continued for 30 min. Thereupon, a white precipitate was deposited. It was filtered off, and washed with successive, acetonitrile and water. Thus, 10.7 g (0.030 mol) of N-acetyl-N-tribromoacetylhydrazine (3-a) was obtained. Yield 48%.

9 g (0.025 mol) portion of (3-a) was dissolved in 50 ml of acetonitrile, and stirred with refluxing. Thereto, a solution of 7.8 g (0.051 mol) of phosphorus oxychloride dissolved in 20 ml of acetonitrile was added dropwise. After the completion of the dropwise addition, the refluxing was further continued for 1 hour. At the conclusion of the refluxing, the reaction mixture was poured into ice water, and the pale yellow precipitate deposited was filtered off, washed with water and dried. Then, the product was recrystallized from n-hexane to obtain 5.6 g (0.0167 mol) of colorless needle crystals. Yield 67%. Melting point 126°-127° C.

| | Elemental Analysis | | | |
|---|---|---|---|---|
| | H | C | N | Br |
| Calcd. | 0.90 | 16.35 | 8.37 | 71.60 |
| Found | 0.83 | 16.24 | 8.42 | 71.74 |

Besides the above-described process, (1) can be obtained by treating (2) directly in the mixture of tribromoacetic acid and phosphorus oxychloride, as illustrated by the following reaction scheme:

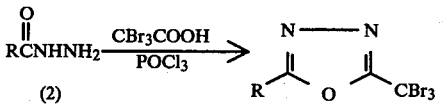

(2) (1)

SYNTHESIS EXAMPLE 2

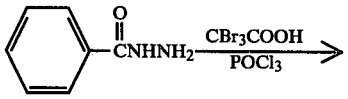

(2-b)

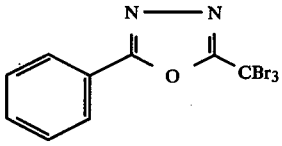

(1-b)

4.08 g (0.03 mol) of benzohydrizide (2-b) and 12 g (0.04 mol) of tribromoacetic acid were added to 30 ml of phosphorus oxychloride, and the resulting mixture was refluxed for 1.5 hours. Then, it was poured into ice water, and a pale yellow precipitate deposited was filtered off, washed with water and dried. Thereafter, the product was recrystallized from n-hexane to obtain 7.4 g (0.019 mol) of colorless needle crystals (1-b). Yield 63%. Melting point 112°-113° C.

| | Elemental Analysis | | | |
|---|---|---|---|---|
| | H | C | N | Br |
| Calcd. | 1.27 | 27.24 | 7.06 | 60.40 |
| Found | 1.15 | 27.21 | 7.14 | 60.45 |

An organic silver salt which constitutes component (a) to be employed in this invention is a colorless, a white or a light-colored compound in its ordinary state, but when heated up to 80° C. or higher in the presence of an optically exposed photocatalyst (described hereinafter) it can react with a reducing agent (described hereinafter) to produce silver. Therefore, it functions as the image-forming component in a heat-developable photographic material. Examples of such organic silver salts include silver salts of organic compounds containing imino, mercapto, thion or carboxyl groups in their individual molecules. Specific examples include the following compounds.

(1) Specific examples of imino group-containing organic compounds include silver salts of benzotriazoles, silver salts of phthalazinones, silver salts of benzoxazinediones, silver salts of imidazoles, silver salts of tetraazaindenes, silver salts of pentaazaindenes and the like.

(2) Specific examples of the silver salts of mercapto or thione group-containing organic compounds include silver salts of 2-mercaptobenzoxazoles, silver salts of mercaptooxadiazoles, silver salts of 2-mercaptobenzothiazoles, silver salts of 2-mercaptobenzimidazoles, silver salts of 3-mercapto-4-phenyl-1,2,4-triazoles and the like.

(3) Specific examples of the silver salts of carboxyl group-containing organic compounds include silver salts of aliphatic carboxylic acids, silver salts of aromatic carboxylic acids (e.g., silver benzoate, silver phthalate, silver phenylacetate, silver 4'-n-octadecyloxyphenyl-4-carboxylate, etc.) and the like.

More detailed specific examples of these organic silver salts and those of other useful organic silver salts are described in U.S. Pat. Nos. 3,457,075, 3,549,379, 3,785,830, 3,933,507 and 4,009,039 (each of which are incorporated herein by reference to disclose such salts), British Pat. No. 1,230,642, and Japanese Patent Application (OPI) Nos. 93139/75, 99719/75, 141222/77 and 36224/78. In this invention, also, the organic silver salts to be used as component (a) can be properly chosen from these known organic silver salts. For instance, when silver halides or silver-dye light-sensitive complexes are used as a photocatalyst, organic silver salts relatively stable to light are selected from the above-described known ones. Preferable examples of such salts include silver salts of a long chain aliphatic carboxylic acids containing 10 to 40, preferably 18 to 33, carbon atoms, with specific examples including silver laurate, silver myristate, silver palmitate, silver stearate, silver arachidinate, silver behenate, silver lignocerate, silver pentacosanate, silver cerotate, silver heptacosanate, silver montanate, silver melissinate and silver laccerate.

These organic silver salts are synthesized according to various known methods as described in, for example, U.S. Pat. Nos. 3,457,075, 3,458,544, 3,700,458, 3,839,049 and 3,960,908, British Pat. No. 1,173,426, and Japanese Patent Application (OPI) Nos. 52626/74, 122011/76 and 14122/77. In particular, the synthesis of organic silver salts in the presence of polymers, as described in U.S. Pat. No. 3,700,458 and Japanese Patent Application (OPI) No. 32015/78, or metal-containing compounds, as described in U.S. Pat. No. 3,887,597 and Japanese Patent Application (OPI) No. 13224/74, are preferred, because organic silver salts having improved grain form, grain size and/or photographic properties can be obtained. The polymer is used in an amount of about 0.1 to about 1,000 g, and preferably about 1 to about 500 g, per 1 mol of organic silver salt to be prepared, and the metal-containing compound is used in an amount of about $10^{-6}$ to $10^{-1}$ mol per mol of organic silver salt to be prepared.

Of the organic silver salts prepared as described above, the salts whose grain sizes are about 0.01 micron to about 10 microns, and particularly about 0.1 micron to about 5 microns, in length are employed to advantage.

The organic silver salt to be employed as component (a) in this invention is coated in an amount reduced to a silver basis ranging from about 0.1 g to about 4 g, and preferably from about 0.2 g to about 2.5 g, per 1 $m^2$ of support. These amounts can provide the proper degree of image density. Namely, when component (a) is used in an amount smaller than the above-described range, the image produced has insufficient density and, if it is used in an amount larger than the above-described range, an increase in image density cannot be attained and the material is more expensive to produce.

A photocatalyst which can be used as component (b) in this invention is a substance that when irradiated with electromagnetic radiation, may be converted into or may have an ability of releasing a compound which will catalyze the silver (image) forming reaction, i.e., at as a catalyst for the reaction of an organic silver salt, component (a), and a reducing agent, component (c), only when heated up to 80° C. or higher. Accordingly, the photocatalyst functions as a light-sensitive component and a catalytic component for the silver (image) forming reaction in the heat-developable photographic materials. Suitable examples of such a photocatalyst include inorganic photoconductive substances such as zinc oxide, titanium oxide and the like; salts of heavy metals and diazosulfonic acid or diazosulfinic acid which are described in U.S. Pat. No. 3,152,904; and/or light-sensitive silver salts such as light-sensitive complexes of silver and dyes described in Japanese Patent Publication No. 25498/74, Japanese Patent Application (OPI) No. 4728/71, and U.S. Pat. No. 3,933,507; and light-sensitive silver halide described in U.S. Pat. No. 3,457,075. The photocatalyst is used in an amount of usually about 0.001 mol to 10 mols, and more particularly about 0.01 mol to about 1 mol, per mol of organic silver salt.

In these photocatalysts, light-sensitive silver halides, e.g., silver chloride, silver bromide, silver iodide, silver chlorobromoiodide, silver chlorobromide, silver chloroiodide, silver iodobromide and the mixtures thereof, are used to the greatest advantage in this invention. A preferable grain size of such a light-sensitive silver halide ranges from about 0.01 micron to about 2 microns, and particularly from about 0.03 micron to about 0.3 micron. A preferable amount of the light-sensitive silver halide used ranges from about 0.001 mol to 0.7 mol, and particularly from about 0.03 mol to about 0.5 mol, per mol of organic silver salt.

The light-sensitive silver halide is prepared in advance in a form of an emulsion, such as the Lippmann's emulsion, the ammonia process emulsion, emulsions ripened with thiocyanate or thioether, and so on, using any of methods known in the photographic art, e.g., a single jet method, a double jet method and so on. Then, the thus prepared light-sensitive silver halide is mixed with other components of this invention, and introduced into the composition to be employed in this invention. In order to allow the organic silver salt and the light-sensitive silver halide to come into sufficient contact with each other upon the introduction into the composition, the means of employing as the protective polymer for making the light-sensitive silver halide emulsion particular polymers, other than gelatin, like polyvinyl acetals described in U.S. Pat. Nos. 3,706,564, 3,706,565, 3,713,833 and 3,748,143, and British Pat. No. 1,362,970; the means of enzymatically decomposing gelatin contained in the light-sensitive silver halide emulsion, as described in British Pat. No. 1,354,186; the means of omitting the use of protective polymers by preparing the light-sensitive silver halide grains in the presence of surface active agents, as described in U.S. Pat. No. 4,076,539, or so on can be adopted.

Further, the light-sensitive silver halide to be employed in this invention can be produced almost simultaneously with the production of the organic silver salt by injecting a silver ion solution into the mixture in which a halogenating agent and an organic silver salt forming component are copresent, as described in British Pat. No. 1,447,454.

Furthermore, the method of acting a light-sensitive silver halide forming component on a previously prepared organic silver salt solution or dispersion, or a sheet material containing an organic silver salt to convert a part of the organic silver salt into the light-sensitive silver halide can also be employed. The thus prepared light-sensitive silver halide effectively contacts the organic silver salt to exhibit a desirable effect. The above-described term light-sensitive silver halide forming component describes a compound capable of forming a light-sensitive silver halide by the reaction with an organic silver salt. The type of compounds which fall under the category of this component and are effective as this component can be judged by the following simple test. That is, the compound to be tested is mixed with an organic silver salt and, optionally, they are heated. Thereafter, the mixture is examined using X-ray diffractiometry as to whether the diffraction peak characteristic to the silver halide is present or not. Examples of light-sensitive silver halide forming components which can be confirmed as being effective by a test as described above include inorganic halogenides, onium halides, halogenated hydrocarbons, N-halogeno compounds and other halogen-containing compounds. Specific examples of such compounds are illustrated in detail in U.S. Pat. Nos. 4,009,039, 3,457,075 and 4,003,749, British Pat. No. 1,498,956 and Japanese Patent Application (OPI) Nos. 27027/78 and 25420/78. Some of these specific examples are described below.

(1) Inorganic halogenides: For example, halogenides represented by MXn (wherein M is H, $NH_4$ or a metal atom; X is Cl, Br or I; and n is 1 when M is H or $NH_4$, and when M is a metal atom n represents the valency of the metal atom. Examples of the metal atom include lithium, sodium, potassium, cesium, magnesium, calcium, strontium, barium, zinc, cadmium, mercury, tin, antimony, chromium, manganese, iron, cobalt, nickel, rhodium, cerium and so on) are effective. In addition, halogen molecules like bromine water are also useful.

(2) Onium halides: Examples include quaternary ammonium halides such as trimethylphenylammonium bromide, cetylethylammonium bromide, trimethylbenzylammonium bromide and the like; quaternary phosphonium halides such as tetraethylphosphonium bromide and the like; tertiary sulfonium halides such as trimethylsulfonium iodide and the like; and so on.

(3) Halogenated hydrocarbons: Examples include iodoform, bromoform, carbon tetrabromide, 2-bromo-2-methylpropane and the like.

(4) N-halogeno compounds: Examples include N-chlorosuccinimide, N-bromosuccinimide, N-bromophthalimide, N-bromoacetamide, N-iodosuccinimide, N-bromophthalazone, N-bromooxazolinone, N-chlorophthalazone, N-bromoacetanilide, N,N-dibromobenzenesulfonamide, N-bromo-N-methylbenzenesulfonamide, 1,3-dibromo-4,4-dimethylhydantoin, N-bromourazole and the like.

(5) Other halogen-containing compounds: For example, they include triphenylmethyl chloride, triphenylmethyl bromide, 2-bromoacetic acid, 2-bromoethanol, benzophenone dichloride and so on.

The light-sensitive silver halide forming component as described above is used in a stoichiometrically small amount upon the reaction with the organic silver salt. The amount thereof to be used ranges usually from about 0.001 mol to about 0.7 mol, and more particularly from about 0.03 to about 0.5 mol, per mol of organic silver salt. Two or more of the compounds described above may be used in combination as the light-sensitive silver halide forming component, provided that the total amount of them is within the above-described range. A reaction temperature, a reaction time, a reaction pressure and other conditions for the process of converting a part of an organic silver salt into a light-sensitive silver halide using the light-sensitive silver halide forming component can be properly selected from their respective wide ranges depending upon the preparation purpose. As a guide, it can be said that the reaction temperature usually ranges from about −20° C. to about 70° C., the reaction time usually ranges from about 0.1 second to about 72 hours, and the reaction pressure is preferably set to atmospheric pressure. In addition, it is preferred to conduct this reaction in the presence of a polymer to be used as a binder described hereinafter. In this case, the polymer is used in an amount of about 0.01 to about 100 parts by weight, preferably about 0.1 to about 10 parts by weight, per 1 part by weight of organic silver salt.

Light-sensitive silver halides prepared using the above-described various methods can be chemically sensitized with, for example, sulfur-containing compounds, gold compounds, platinum compounds, palladium compounds, silver compounds, tin compounds, chromium compounds or the combinations of two or more thereof. Procedures for these chemical sensitizations are described in, for example, U.S. Pat. No. 4,036,650, British Pat. No. 1,518,850, and Japanese Patent Application (OPI) Nos. 22430/76, 78319/76 and 81124/76. In addition, in the embodiment of converting a part of an organic silver salt into a light-sensitive silver halide using a light-sensitive silver halide forming component, sensitization can be attained by incorporating low molecular weight amide compounds as described in U.S. Pat. No. 3,980,482 into the reaction system.

The photocatalyst of component (b), especially light-sensitive silver halides, can be spectrally sensitized with various known dyes. Examples of dyes employed effectively for spectral sensitization include cyanine, merocyanine, rhodacyanine, complex (trinuclear, or tetranuclear) cyanine or merocyanine, holopolar cyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above-described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malonitrile nucleus and a pyrazolone. In the above-described cyanine and merocyanine dyes, those having imino groups or carboxyl groups are particularly effective. Practically, the sensitizing dye to be used in this invention is properly selected from known dyes as described in U.S. Pat. Nos. 3,761,279, 3,719,495 and 3,877,943, British Pat. Nos. 1,466,201, 1,469,117 and 1,422,057, Japanese Patent Application (OPI) Nos. 27924/76 and 156424/75, and so on, and can be located in the vicinity of the photocatalyst according to known methods used in the above-described examples. These spectral sensitizing dyes are used in amounts of about $10^{-4}$ mol to about 1 mol per 1 mol of photocatalyst.

A reducing agent to be employed as component (c) in this invention has such a property that when heated up to 80° C. or higher, it can react with an organic silver salt in the presence of an optically exposed photocatalyst to reduce the organic silver salt, and functions as an image forming redox composition together with the organic silver salt in a heat-developable photographic material. A suitable reducing agent is selected with due regard to the kind and the powers of an organic silver salt to be used in combination therewith. For example, reducing agents having high reducing powers are suitable for the combined use with organic silver salts which are difficult to reduce, and reducing agents which are poor in reducing power are suitable for combined use with organic silver salts liable to be reduced.

Examples of compounds which are generally known as reducing agents employable in heat-developable photographic materials include monophenols, polyphenols having two or more of phenolic groups, mononaphthols, bis-naphthols, polyhydroxybenzenes having two or more of hydroxyl groups, polyhydroxynaphthalenes having two or more of hydroxyl groups, ascorbic acids, 3-pyrazolidones, pyrazolidone-5-ones, pyrazolones, phenylenediamines, hydroxylamines, hydroquinone monoethers, hydrooxaminic acids, hydrazides, amidoximes, N-hydroxyureas and so on. More specifically, these reducing agents are described in U.S. Pat. Nos. 3,615,533, 3,679,426, 3,672,904, 3,751,252, 3,782,949, 3,801,321, 3,794,488, 3,893,863, 3,887,376, 3,770,448, 3,819,382, 3,773,512, 3,839,048, 3,887,378, 4,009,039 and 4,021,240, British Pat. No. 1,486,148, Belgian Pat. No. 786,086, Japanese Patent Application (OPI) Nos. 36143/75, 36110/75, 116023/75, 99719/75, 140113/75, 51933/76, 23721/76 and 84727/77, and Japanese Patent Publication No. 35851/76. Component (c) of this invention can be properly chosen from these known reducing agents. Perhaps the simplest way to select the reducing agent consists of the preparation of heat-developable photographic materials using various reducing agents to be examined for reducing powers. The materials prepared are examined for their photographic properties and thereby relative superiority of these agents are evaluated.

Examples of such reducing agents which are more suitable for combined use with silver salts of aliphatic carboxylic acids among the above-described reducing agents include polyphenols in which two or more of phenol groups are bonded to each other through an alkylene group or sulfur, especially polyphenols in which two or more of phenol groups, which each has an alkyl group (e.g., methyl, ethyl, propyl, t-butyl, cyclohexyl, etc.) or an acyl group (e.g., acetyl, propionyl, etc.) at at least one position adjacent to the hydroxy group substituted position, are bonded to each other through an alkylene group or sulfur, with specific examples including 1,1-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3,5-di-t-butylphenyl)methane, 2,6-methylenebis(2-hydroxy-3-t-butyl-5-methylphenyl)-4-methylphenol, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethyl)propane, 2,2-bis(4-hydroxy-3,5-di-t-butylphenyl)propane and the like, as described in U.S. Pat. Nos. 3,589,903 and 4,021,249, British Pat. No. 1,486,148, Japanese Patent Application (OPI) Nos. 51933/76, 36110/75, 116023/75 and 84727/77, and Japanese Patent Publication No. 35727/76, bis-$\beta$-naphthols described in U.S. Pat. No. 3,672,904 (e.g., 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, 4,4'-dimethoxy-1,1'-dihydroxy-2,2'-binaphthyl, etc.); and sulfonamidophenols and sulfonamidonaphthols as described in U.S. Pat. No. 3,801,321 (e.g., 4-benzenesulfonamidophenol, 2-benzenesulfonamidophenol, 2,6-dichloro-4-benzenesulfonamidophenol, 4-benzenesulfonamidonaphthol, etc.).

The amount of the reducing agent to be employed in this invention varies over a wide range depending upon the kind of organic silver salt, the reducing agent and those additives used in combination with them. However, it ranges generally from about 0.05 mol to about 10 mols, preferably from about 0.1 mol to about 3 mols, per mol of organic silver salt. Within the above-described amount range, two or more of the above-described reducing agents may be used in combination.

It is desirable to use additives called a color toning agent, a tone providing agent or an activator toner (called a color toning agent hereinafter) together with the above-described components. A color toning agent participates in the silver (image) forming redox reaction undertaken by an organic silver salt and a reducing agent, and functions so as to impart dark color, especially black color, to the image produced. A large number of different kinds of compounds are known as color toning agents. Most of such compounds have imino, mercapto or thion groups. From these compounds, a suitable color toning agent is selected depending upon the kinds of the organic silver salt and the reducing agent used. Examples of color toning agents which can provide desirable toning effects in this invention include phthalazinones described in U.S. Pat. Nos. 3,152,904, 3,844,797 and 4,076,534 (e.g., phthalazinone, 2-acetylphthalazinone, 2-carbamoylphthalazinone, etc.); 2-pyrazoline-5-ones (e.g., 3-methyl-2-pyrazoline-5-one, etc.) and quinazolinones (e.g., quinazolinone, 4-methylquinazolinone, etc.) described in U.S. Pat. No. 3,846,136; pyrimidines (e.g., 6-methyl-2,4-dihydroxypyrimidine, etc.) and 1,2,5-triazines (e.g., 3-methyl-4,6-dihydroxy-1,2,5-triazine, etc.) described in U.S. Pat. No. 4,030,930; phthalazinediones (e.g., phthalazinedione, etc.) described in Japanese patent Publication No. 36774/78; cyclic imides (e.g., succinimides, phthalimides and urazoles described in U.S. Pat. No. 3,846,136 and Japanese Patent Application (OPI) No. 55115/78; benzoxazinediones described in U.S. Pat. Nos. 3,951,660 and 3,885,967; benzothiazinediones described in Japanese Patent Application (OPI) No. 76020/78; and naphthalimides described in U.S. Pat. No. 3,782,941) and other imino group-containing heterocyclic compounds. These color toning agents may be used in combination with two or more thereof. For example, as described in Japanese Patent Application (OPI) Nos. 1020/78 and 55115/78, combined use of phthalazinones with benzoxazinediones, benzothiazinediones or phthalimides can prevent the occurrence of deterioration of the color toning effect due to storage under high temperature and high humidity.

In addition, combinations of phthalic acid, naphthoic acid or phthalamic acid with imidazoles or phthalazines can be also employed as a color toning agent, as described in U.S. Pat. Nos. 3,847,612 and 3,994,732.

The color toning agent is used in an amount of generally about 0.0001 mol to about 2 mols, and more particularly about 0.0005 mol to about 1 mol, per mol of organic silver salt.

Furthermore, color tones of processed materials are much more improved by employing mercaptotetrazoles (e.g., 5-mercaptotetrazole, or 1-phenyl-5-mercaptotetrazole), precursor of mercaptotetrazoles as described in U.S. Pat. Nos. 3,311,474, 3,993,661 or, etc. (e.g., 1-phenyl-5-(p-methylphenylsulfonylthio)tetrazole or etc.), 5-substituted-2-mercaptooxadiazoles (e.g., 5-methyl-2-mercaptooxadiazole or etc.), 5-substituted-2-mercaptothiadiazoles (e.g., 5-methyl-2-mercaptothiadiazole or etc.), 5-substituted-3-mercapto-1,2,4-triazoles (e.g., 4,5-diphenyl-3-mercapto-1,2,4-triazole or etc.) and/or disulfides (e.g., di(1-phenyl-5-tetrazolyl)disulfide or etc.) in an amount 0.0001 mol to 2 mols per mol of organic silver salt.

Compounds effective for preventing color changes of processed materials from occurring in their white areas due to exposure to light, which are known in this art, may be used together with the components constituting the heat-developable photographic material of this invention. Suitable examples of such compounds include stabilizer precursors such as azole thioethers and blocked azole thiones, as described in U.S. Pat. No. 3,839,041; tetrazolyl compounds and their precursors as described in U.S. Pat. No. 3,700,457; halogen-containing compounds as described in U.S. Pat. Nos. 3,707,377, 3,874,946, 3,955,982 and 4,108,665; elemental sulfur and sulfur-containing compounds as described in U.S. Pat. No. 4,036,650; and so on. These compounds may be used in combination with two or more thereof.

Further, known heat fog inhibitors may be used together with component (e) of this invention. Examples of known heat fog inhibitors which can be employed herein include mercury compounds described in U.S. Pat. No. 3,589,903; N-halogeno compounds described in U.S. Pat. No. 3,957,493; benzenethiosulfonic acids as described in Japanese Patent Application (OPI) No. 78227/76; cerium compounds as described in Japanese Patent Application (OPI) No. 24520/77; and other heat fog inhibitors described in Japanese Patent Application (OPI) Nos. 101019/75, 116024/75, 123331/75, 134421/75, 47419/76, 42529/76, 51323/76, 57435/76, 104338/76, 32015/78, 22431/76, 54428/76, 75433/76, 122430/76, 1020/78, 19825/78 and 28417/78. These inhibitors may be used individually or in combination.

In the case of photographic materials containing silver sulfide (e.g., photographic materials sensitized with sulfur compounds), it is observed that the stabilizers of the tetraazaindene type function so as to slightly depress any increase in image density due to the presence of silver sulfide which proceeds slowly over a long period. However, they usually have no effect on heat-developable photographic materials. Useful tetraazaindenes are described in T. H. James, *The Theory of The Photographic Process,* 4th Ed., pp. 398–399, Macmillan Publishing Co. Inc., New York, and so on.

Further, not only mercapto compounds and thioether compounds described in Japanese Patent Application (OPI) Nos. 70543/81 and 99353/81, but also disulfides and polysulfides may be used in combination with the antifogging agent of this invention.

Every component to be employed in this invention is dispersed in at least one colloid acting as a binder of component (d). Suitable examples of the binder are hydrophobic macromolecular materials. However, hydrophilic macromolecular materials may be used in combination with hydrophobic ones, or independently under certain circumstances. Macromolecular materials which can provide transparent or translucent and that, colorless, white or light-colored layers or films when coated, or spread with pouring are preferably employed as the binder. Examples of such materials include natural polymers such as proteins like gelatin, polysaccharides like cellulose compounds and dextran, gum arabic and so on; and synthetic polymers described in U.S. Pat. No. 4,009,039, and Japanese Patent Application (OPI) Nos. 126408/75, 29126/76, 19525/76 and 84443/74. Among these polymers, polyvinyl butyral, polyvinyl acetate, ethyl cellulose, vinylidene chloride-vinyl chloride copolymer, polymethylmethacrylate, vinyl chloride-vinyl acetate copolymer, cellulose acetate butyrate, gelatin and polyvinyl alcohol are particularly advantageous. Optionally, these polymers may be used in combination of two or more thereof. Such a polymer is used in an amount sufficient to carry the components dispersed therein, that is, within an effective range for the action as the binder. The effective range can be determined at the discretion of one skilled in the art. As a guide in the case of carrying at least an organic silver salt, it can be said that a preferable ratio of the binder to the organic silver salt ranges from about 10:1 to 1:10, and particularly from about 4:1 to 1:4, by weight.

When the binder is used to provide a self-supporting film, a composition containing components to be employed in this invention may be molded using a known pouring spread process in the form of a film which carries all the components. However, it is more preferable to coat the composition on a support chosen from various kinds of materials in a form of single layer or multilayer to complete it as a heat-developable photographic material. Specific examples of such a support include various kinds of polymer materials, glass, wool cloth, cotton cloth, paper, metals (e.g., aluminium) and so on. Among these materials, materials capable of being worked upon a flexible sheet or roll are particularly preferable for the application to information recording materials from the handling point of view. Most suitable examples of the support in this invention include plastic films (e.g., a cellulose acetate film, a polyester film, a polyethylene terephthalate film, a polyamide film, a polyimide film, a triacetate film and a polycarbonate film), and papers (e.g., plain paper, photographic raw paper, printing raw papers such as coated paper and art paper, baryta paper, resin-coated paper, paper sized with polysaccharide as described in Belgian Pat. No. 784,615; pigment paper containing pigment like titanium dioxide, and paper sized with polyvinyl alcohol).

In the heat-developable photographic material, various kinds of auxiliary layers, e.g., a metal evaporated layer described in U.S. Pat. No. 3,748,137; a backing layer described in British Pat. No. 1,507,991 or Japanese Patent Application (OPI) Nos. 43130/76 or 129220/76; a backing layer containing a magnetic material described in Japanese Patent Application (OPI) No. 136099/75; an antistatic layer; and a subbing layer described in Japanese Patent Application (OPI) No. 87721/78 can be coated. Further, it is of great advantage to provide an overcoating polymer layer, as described in U.S. Pat. Nos. 3,933,508, 3,856,526, 3,856,527 and 3,893,860, because it can bring good results in that the transparency of each layer provided on the support is heightened, and moisture proofing characteristics or heat resisting characteristics are improved. A suitable thickness of the overcoating polymer layer ranges from about 1 micron to about 20 microns. Suitable examples of the polymer for the overcoating layer include those described in each specification cited above as the polymers for the overcoating polymer layer. Among such polymers, polyvinyl chloride, polyvinyl acetate, vinyl chloride-vinyl acetate copolymer, polystyrene, methyl cellulose, ethyl cellulose, cellulose acetate butyrate, vinyl chloride-vinylidene chloride copolymer, carboxylic acid esters, cellulose diacetate, polyvinylidene chloride, polycarbonate, gelatin, polyvinyl alcohol and so on are particularly preferable.

In the layer or the film containing the components of this invention, or each of the auxiliary layers, additives known in the art of heat-developable photographic materials, for example, a plasticizer, a matting agent, a surface active agent, a sensitizer, a brightening agent, a light absorbing agent, a filter dye, an antihalation dye, color couplers, a hardener, a lubricant, a development accelerating agent, a stabilizer and so on, can be incorporated. Concrete compound names and embodiments of these additives are described in *Product Licensing Index,* Vol. 92, No. 9232, pp. after 107 (Dec. 1971), Japanese Patent Application (OPI) Nos. 33615/78, 119623/75, 57619/75 and 27923/76, and U.S. Pat. Nos. 3,769,019, 3,821,001, 3,667,959, 3,871,887, 3,885,965, 4,021,250, 4,036,650, 3,531,286 and 3,764,328.

Processes for preparing the heat-developable photographic materials of this invention are roughly illustrated below. An organic silver salt prepared using one of the known methods is optionally washed with water, an alcohol or the like and then mixed with a photocatalyst to make a mixture in which both are present in a close contact state. In another way, a photocatalyst and an organic silver salt may be produced at the same time. In the most preferable way, a part of an organic silver salt is converted into silver halide using a silver halide forming component. When using sensitizing dyes, it is preferable to add the sensitizing dyes in the form of a solution after the above-described mixing step to the resulting mixture. The mixture of the organic silver salt and the photocatalyst is desirably prepared in the form of polymer dispersion dispersed in a solution of a polymer which can function as the binder afterward. This polymer can be added in any of the steps, such as the step of preparing the organic silver salt, the step of mixing with the photocatalyst, the step of preparing the photocatalyst, or so on. The polymer dispersion of the organic silver salt and the photocatalyst is molded in a film or coated in a layer on a support, and other components of this invention may be incorporated into that film or a layer provided on that layer. More preferably, other components to be employed in this invention, i.e., at least a reducing agent and component (d) of this invention, are added to the above-described polymer dispersion of the organic silver salt and the photocatalyst to prepare a heat-developable photographic composition, and the resulting composition is poured and spread into a film or coated in a layer on a support using a known method. When coating the composition, various kinds of coating methods, for example, a dip coating method, an air knife coating, a curtain coating method, a hopper coating method and so on, can be employed. In addition, various kinds of auxiliary layers, for example, a subbing layer, an overcoating layer and so on, can be optionally coated on prior to, simultaneously with or subsequently to the coating of the heat-developable photographic composition using a similar method to one of the above-described methods.

Solvents to be used for the coating solutions may be arbitrarily selected. For instance, noncombustible solvents as described in British Pat. No. 1,422,145 can be used.

Optionally, printing can be carried out on the surface or the back of the support, or on a layer provided on the support. Therefore, the materials of this invention on which prescribed patterns are printed can be applied to a (season) ticket, a post card and other correspondence.

The thus prepared heat-developable photographic material is cut in a size suitable for use, and subjected to imagewise exposure. Preheating (up to 80° C.–140° C.) may be carried out prior to the exposing step, if necessary. Suitable light sources for imagewise exposure include a tungsten lamp, a fluorescent lamp for a copier as used mainly for exposure of diazo type light-sensitive materials, a mercury lamp, an iodine lamp, a xenon lamp, a cathode ray tube (CRT) light source, a laser light source and so on. As for an original, not only line images like drafting, but also photographic images having gradation and, further, a person or a landscape photographed with a camera can be employed. Printing may be carried out using a contact printing method as an original is superposed directly on the photographic material, or using a reflection printing method or an enlarging printing method. A suitable exposure is determined depending upon the sensitivity of the photographic material used. It is about 1 lux.sec in the case of high-speed photographic materials, and about $10^3$ lux.-sec in the case of low-speed ones. The thus imagewise exposed photographic material can be developed only by heating (up to a temperature higher than about 80° C., and preferably ranging from about 100° C. to about 150° C.). The heating time is adjusted to an arbitrary value within the range of 1 sec to 60 sec or so. It is preferably determined depending upon the heating temperature adopted. Usually, about 5 sec to about 40 sec are suitable for 120° C., about 2 sec to about 20 sec for 130° C., and about 1 sec to about 10 sec for 140° C. Heating may be carried out using various means. For example, the photographic material may be simply made to come into contact with a hot plate or drum, or may be made to pass through a heated space as circumstances require. Further, a high frequency wave-induced heating means, or a laser beam-induced heating means may be adopted.

This invention will now be illustrated in more detail by reference to the following examples.

EXAMPLE 1

A polymer dispersion of a silver salt was prepared by dispersing a composition comprised of the following weights of ingredients by means of a homogenizer.

| Composition of Polymer Dispersion: | |
|---|---|
| Silver Behenate | 76 g |
| Polyvinyl Butyral | 80 g |
| Isopropyl Alcohol | 200 g |
| n-Butyl Acetate | 200 g |

The resulting polymer dispersion was maintained at 50° C. and thereto, a solution of 4 g of N-bromosuccinimide in 100 ml of acetone was added and heated for a period of 90 min to convert a part of the silver behenate into silver bromide.

The thus prepared silver behenate-silver bromide polymer dispersion was maintained at 40° C. and thereto were added the following volumes of ingredients in their order of description to prepare a coating composition:

| | |
|---|---|
| Reducing agent of the following formula (16 wt % of acetone solution) | 140 ml |

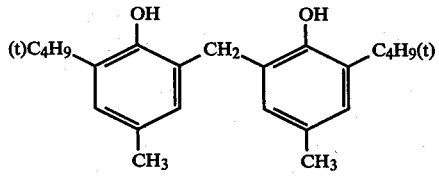

| | |
|---|---|
| Sensitizing dye of the following formula (0.1 wt % of ethylene glycol | 140 ml |

-continued monomethyl ether solution)

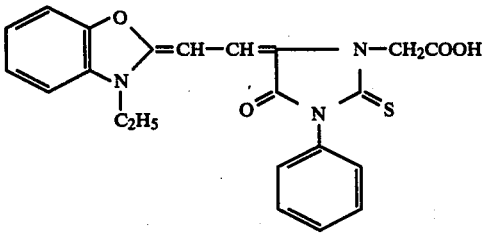

| | |
|---|---|
| Phthalazinone (16 wt % of ethylene glycol monomethyl ether solution) | 140 ml |
| 2-Tribromomethyl-5-methyl-3,4-oxadiazole (1 wt % methyl ethyl ketone solution) | 100 ml |
| Hexamethylenediisocyanate (1 wt % n-butyl acetate solution) | 40 ml |

The thus prepared coating composition was coated on photographic raw paper so as to have a coverage of 0.4 g silver per square meter, and dried. Further, a 2 wt% of acetone solution of cellulose diacetate was coated as an overcoating layer so as to have a coverage of 0.4 g polymer per square meter. The thus obtained heat-developable material was referred to as "photographic material A".

For the purpose of comparison, a comparative material "photographic material B-1" was prepared in the same manner as in "photographic material A" except that 2-tribromomethyl-5-methyl-3,4-oxadiazole was not added.

Further, another comparative material "photographic material B-2" was prepared in the same manner as in "photographic material A" except that 100 ml of a 1 wt% of methyl ethyl ketone solution of tribromoacetophenone was added instead of the addition of 2-tribromomethyl-5-methyl-3,4-oxadiazole. Still another comparative material "photographic material B-3" was prepared in the same manner as in "photographic material A" except that 40 ml of a 1 wt% methanol solution of mercury (II) acetate was added instead of the addition of 2-tribromomethyl-5-methyl-3,4-oxadiazole.

Each of these materials was exposed to light through an optical wedge in an exposure of $10^3$ lux.sec and then heated at a temperature of 120° C. for 10 seconds to produce a black image. Reflection density of each of the thus produced images was measured. The standard point of the reflection density to determine the sensitivity was fog+0.1. The results obtained are shown in Table 1 as relative values of "photographic material B-3" taken as 100. In addition, data of heat fog and maximum density are also shown in Table 1.

TABLE I

| Sample | Relative Sensitivity | Heat Fog | Maximum Density |
|---|---|---|---|
| A | 98 | 0.07 | 1.25 |
| B-1 | 110 | 0.60 | 1.40 |
| B-2 | 105 | 0.55 | 1.35 |
| B-3 | 100 | 0.06 | 1.30 |

As can be seen from Table 1, the photographic material A of this invention had a very large heat fog preventing effect and showed small decreases in the sensitivity and the maximum density, compared with the comparative materials B-1 and B-2, and that, there was slight differences in the photographic properties between the photographic material A and the comparative material B-3 in which the mercury compound was used. Further, though the photographic material A was all stand on a sharcasten for one hour, no increase in fog at the white background was caused. Furthermore, though the photographic material A was allowed to stand for 3 days in the dark under the condition of 50° C., 70% RH, an increase in fog at the white background was hardly observed.

EXAMPLE 2

Heat-developable photographic materials were prepared in the same manner as in the photographic material A of Example 1 except that the compounds set forth in Table 2, respectively, were used instead of 2-tribromomethyl-5-methyl-3,4-oxadiazole. These materials were named C, D, E, F, G, H, I and J, respectively.

TABLE 2

| Sample | Compound Name |
|---|---|
| C | 2-Tribromomethyl-5-palmityl-3,4-oxadiazole |
| D | 2-Tribromomethyl-5-phenoxymethyl-3,4-oxadiazole |
| E | 2-Tribromomethyl-5-(1-bromoethyl)-3,4-oxadiazole |
| F | 2-Tribromomethyl-5-phenyl-3,4-oxadiazole |
| G | 2-Tribromomethyl-5-(p-chlorophenol)-3,4-oxadiazole |
| H | 2-Tribromomethyl-5-(4-pyrydyl)-3,4-oxadiazole |
| I | 2-(Chlorodibromomethyl)-5-phenyl-3,4-oxadiazole |
| J | 2-(Dichlorobromomethyl)-5-phenyl-3,4-oxadiazole |

The results of sensitometry carried out in the same manner as in Example 1 are shown in Table 3.

TABLE 3

| Sample | Relative Sensitivity | Heat Fog | Maximum Density |
|---|---|---|---|
| C | 105 | 0.08 | 1.25 |
| D | 100 | 0.07 | 1.30 |
| E | 90 | 0.06 | 1.30 |
| F | 95 | 0.07 | 1.35 |
| G | 90 | 0.07 | 1.30 |
| H | 100 | 0.07 | 1.30 |
| I | 101 | 0.08 | 1.30 |
| J | 102 | 0.09 | 1.30 |

The data shown in Table 3 clearly shown that photographic materials having very reduced fog were prepared in accordance with this invention.

While the invention has been described in detail and with reference to specific embodiments thereof, it will be apparent to one skilled in the art that various changes and modifications can be made therein without departing ffrom the spirit and scope thereof.

What is claimed is:

1. A heat-developable photographic material, comprising:

a binder having dispersed therein:

an organic silver salt;

a photocatalyst;

a reducing agent; and a compound represented by the general formula:

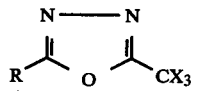

wherein X is a halogen atoms and R is hydrogen, an alkyl group, an aryl group, an aralkyl group, an alkenyl group or a heterocyclic group, wherein said compound is present in an antifogging amount.

2. A heat-developable photographic material as claimed in claim 1, wherein the binder, organic silver salt, photocatalyst, reducing agent, and compound represented by the general formula are coated on a support.

3. A heat-developable photographic material as claimed in any of claims 1 or 2, wherein X is Br.

4. A heat-developable photographic material as claimed in any of claims 1 or 2, wherein R is an alkyl group containing 1 to 18 carbon atoms.

5. A heat-developable photographic material as claimed in any of claims 1 or 2, wherein R is a phenyl group.

6. A heat-developable photographic material as claimed in any of claims 1 or 2, wherein R is an aralkyl group containing 7 to 30 carbon atoms.

7. A heat-developable photographic material as claimed in any of claims 1 or 2, wherein R is an alkenyl group containing 2 to 30 carbon atoms.

8. A heat-developable photographic material as claimed in any of claims 1 or 2, wherein R is a heterocyclic residue consisting of 5- or 6-membered rings each of which rings contain a hetero atoms selected from O, N, S.

9. A heat-developable photographic material as claimed in any of claims 1 or 2, wherein the compound represented by the general formula is present in an amount of from $10^{-5}$ to 1 mol per mol of silver.

10. A heat-developable photographic material as claimed in claim 9, wherein the compound represented by the general formula is present in an amount of $10^{-3}$ to $5\times10^{-1}$ mol per mol of silver.

11. A heat-developable photographic material as claimed in claim 10, wherein the organic silver salt is a silver salt of a long chain aliphatic carboxylic acid containing 18 to 35 carbon atoms and is present in an amount reduced to a silver bases ranging from about 0.1 g to about 4 g/m$^2$.

12. A heat-developable photographic material as claimed in claim 11, wherein the silver is present in an amount of about 0.2 g to about 2.5 g/m$^2$.

13. A heat-developable photographic material as claimed in any of claims 1 or 2, wherein the photocatalyst is present in an amount of about 0.01 mol to about 1 mol per mol of organic silver salt.

14. A heat-developable photographic material as claimed in claim 13, wherein the photocatalyst is a light-sensitive silver halide present in an amount of 0.03 mol to about 0.5 mol per mol of organic silver salt.

15. A heat-developable photographic material as claimed in any of claims 1 or 2, wherein the reducing agent is present in an amount of 0.05 mol to about 10 mol per mol of organic silver salt.

16. A heat-developable photographic material as claimed in claim 15, wherein the reducing agent is present in an amount of from about 0.1 mol to about 3 mol per mol of organic silver salt.

17. A heat-developable photographic material as claimed in any of claims 1 or 2, wherein the ratio of the binder to the organic silver salt ranges from about 10:1 to 1:10 by weight.

18. A heat-developable photographic material as claimed in claim 17, wherein the ratio of the binder to the organic silver salt ranges from about 4:1 to 1:4 by weight.

* * * * *